US007882660B2

(12) United States Patent
Kitagawa

(10) Patent No.: US 7,882,660 B2
(45) Date of Patent: Feb. 8, 2011

(54) KNOCKDOWN STRUCTURE AND METHODS OF ASSEMBLING SAME

(75) Inventor: Katsuyuki Kitagawa, Kaga (JP)

(73) Assignee: Yugenkaisha Japan Tsusyo (JP)

( * ) Notice: Subject to any disclaimer, the term of this patent is extended or adjusted under 35 U.S.C. 154(b) by 246 days.

(21) Appl. No.: 11/908,238

(22) PCT Filed: Mar. 10, 2005

(86) PCT No.: PCT/JP2005/004235

§ 371 (c)(1),
(2), (4) Date: Dec. 17, 2008

(87) PCT Pub. No.: WO2006/095430

PCT Pub. Date: Sep. 14, 2006

(65) Prior Publication Data

US 2009/0126292 A1 May 21, 2009

(51) Int. Cl.
*E04B 7/08* (2006.01)
*E04B 9/00* (2006.01)
*E04B 1/00* (2006.01)

(52) U.S. Cl. ..... 52/81.1; 52/454; 52/741.4

(58) Field of Classification Search ..... 52/82, 52/80.1, 80.2, 81.1, 169.14, 292, 302.3, 741.4
See application file for complete search history.

(56) References Cited

U.S. PATENT DOCUMENTS 3,547,260 A * 12/1970 Munn ..... 209/3
4,094,110 A * 6/1978 Dickens et al. ..... 52/81.1
4,985,080 A * 1/1991 Jung ..... 106/672
5,182,891 A * 2/1993 Slocum ..... 52/480
6,004,888 A * 12/1999 Sugimoto et al. ..... 442/60
6,324,791 B1 * 12/2001 Azpiroz Villar ..... 52/80.1
6,658,800 B2 * 12/2003 Monson et al. ..... 52/81.1
6,660,079 B2 * 12/2003 Jodlbauer et al. ..... 106/724
6,745,589 B2 * 6/2004 Katatani et al. ..... 62/259.1

FOREIGN PATENT DOCUMENTS

JP 5-141016 6/1993
JP 05141016 6/1993
JP 7-33705 4/1995

(Continued)

*Primary Examiner*—Brian E Glessner
*Assistant Examiner*—Benjamin Pevarski
(74) *Attorney, Agent, or Firm*—Lowe Hauptman Ham & Berner, LLP

(57) ABSTRACT

A knockdown structure and assembly method are provided so as to prevent cracking of the sealant, reinforce the junction between sections, and improve the livability of the structure. A structure's body is assembled by using a mortar-powder mixed adhesive to join together a plurality of sections that are made of foam polystyrene and that constitute the parts of a structure having a predetermined shape. The adhesive is applied to cover at least the places where the sections are joined together with a woven inorganic-fiber mesh sheet. A sealant is applied, made by dispersing inorganic fiber and mortar powder in a plastic-type paint, onto the exterior and interior faces of the structure in a predetermined thickness. Onto the sealant of the exterior of the structure is applied, on the exterior of the structure, a paint that is water repellant and can screen out ultraviolet light, and applying, over the sealant of the interior of the structure, a clayey paint made of natural substances.

11 Claims, 8 Drawing Sheets

FOREIGN PATENT DOCUMENTS

| | | |
|---|---|---|
| JP | 07033705 | 4/1995 |
| JP | 10026367 | 1/1998 |
| JP | 11200595 | 7/1999 |
| JP | 2000160732 | 6/2000 |
| JP | 2001089222 | 4/2001 |
| JP | 2004211443 | 7/2004 |
| JP | 2004278150 | 10/2004 |
| WO | 0144593 | 6/2001 |

* cited by examiner

KNOCKDOWN STRUCTURE AND METHODS OF ASSEMBLING SAME

CROSS-REFERENCE TO RELATED APPLICATIONS

The present Application is based on International Application No. PCT/JP2005/004235, filed Mar. 10, 2005 and priority is hereby claimed under 35 USC §119 based on this application. This application is hereby incorporated by reference in its entirety into the present application.

FIELD OF THE INVENTION

The present invention relates to a knockdown structure suitable for an outdoor accommodation facility, a leisure facility, or other facility, and to methods of assembly thereof.

BACKGROUND OF THE INVENTION

To use a bungalow made of wood, or a tent made of cloth, for an outdoor facility such as an outdoor accommodation and the like is well-known. However, assembling a bungalow has problems, being bothersome and laborious because (1) metal angles and brackets must be used in assembling the wood materials, and (2) fastening with bolts also is necessary. And although a tent is easy to set up, it also has problems, because a tent lacks good livability because its durability and adiathermancy are poor.

Patent Document 1 describes an outdoor facility that has a dome-like shape and that is assembled by joining together a plurality of sections made of foam polystyrene, which is a substance that is light and has good adiathermancy. As a result, a facility made of foam polystyrene has good livability. In addition, foam polystyrene does not generate poisonous gas when it is burned in order to be disposed of, and thus it has the advantage that it does not adversely impact the environment when disposed of.

Patent Document 1: International Publication Number WO 01/44593

DISCLOSURE OF THE INVENTION

Problems to be Solved

A knockdown structure assembled by joining together a plurality of sections made of foam polystyrene has the following problems.

Mortar is used as a sealant on the surface of foam polystyrene, but sometimes the sealant experiences cracking due to external pressure such as wind, snow, or rain. Although cracks do not undermine the function of the knockdown structure, its exterior appearance diminishes. Taking countermeasures against cracks by thickening the sealant requires much manpower and time, especially when doing so for vertical walls.

If the adhesion that bonds the sections together is not sufficient, an unfilled gap—i.e., a concave part—can result between the sections that are bonded together. This causes the sealant to have an uneven thickness. The uneven thickness of the sealant causes some parts of the sealant to dry sooner than other parts do. This difference in drying time can result in cracking of the sealant.

To protect foam polystyrene against degradation caused by ultraviolet light, paint mixed with titanium oxide powder is applied thereon. However, such paint, which screens out ultraviolet light, easily comes off due to rain and snow. Therefore, maintenance, and sometimes repair, is necessary.

There is an assembly method whereby metal beams and bars are attached to the junction between sections to be bonded together, so as to reinforce the connection between the sections. But this assembly method is complex and expensive.

The object of the present invention is to provide (1) a knockdown structure that can avoid cracking of the sealant, reinforce the connections of the structure's sections, and improve the livability of the structure, and (2) methods of assembling such a knockdown structure.

Means for Solving the Problems

The invention relates to a method of assembling a knockdown structure. The body of the structure is assembled, which has a predetermined shape, by using a mortar-powder mixed adhesive to join together a plurality of sections that are made of foam polystyrene and that constitute the parts of the structure. An adhesive is applied on a mesh sheet, which consists of a woven inorganic fiber, in such a way that the mesh sheet is glued to at least the places where the sections are joined together, with the adhesive bonding the sections together. A sealant is applied, in a predetermined thickness. The sealant is made by dispersing inorganic fiber and mortar powder in a plastic-type paint on the exterior and interior faces of the body of the structure, over the sealant that is on the exterior faces of the structure's body, an exterior paint is applied that is water repellent and that screens out ultraviolet light, and over the sealant that is on the interior faces of the structure's body, a clayey paint is applied that is made of natural substances.

In another aspect of the invention a method of assembling the knockdown structure is disclosed, wherein the mesh sheet is placed and glued in such a way that it covers almost all of the exterior of the assembled structure's body.

In yet a further aspect of the invention is a method, of assembling the knockdown structure is disclosed, wherein the plurality of sections are arranged in a standing condition on a base. Each section's lower part, which stands on the base, and the corresponding part of the base itself are covered with the mesh sheet, and the sealant is applied on the exterior and interior faces of the structure's body, including the parts covered with the mesh sheet.

In another aspect of the invention the knockdown structure is assembled, wherein the sealant that is applied to the upper half of the interior faces of the structure is covered by the clayey paint that is made of natural substances. The sealant that is applied to the lower half of the interior faces of the structure is covered by the exterior paint.

A modified silicone-plastic paint can also be used as the exterior paint.

In another aspect of the invention the knockdown structure is assembled, wherein diatomite or a whitewash is used as the clayey paint that is made of natural substances.

In another aspect of the invention a body of a knockdown structure is assembled by joining together a plurality of sections which are made of foam polystyrene and that are divided into the parts of the body of the structure, which has a predetermined shape—using an adhesive mixed with mortar powder. A mesh sheet includes a woven inorganic fiber arranged in such a way that the mesh sheet covers at least the places where the sections are joined together. A sealant which is made by dispersing inorganic fiber and mortar powder in a plastic-type paint is applied on the exterior and interior faces of the structure's body in a predetermined thickness. An exterior paint which is water-repellent and can screen out ultraviolet light is applied over the sealant that is on the exterior of the structure, and a clayey paint that is made of natural substances is applied over the sealant that is on the interior of the structure.

The mesh sheet can be arranged in such a way that it covers almost all of the exterior of the structure.

In another aspect of the invention an air-circulation means are used to circulate, through the sections, the air inside the structure and an air-cleaning means disposed in the flow path of the air that is circulated by the air-circulation means.

Air-heating means can be disposed in the flow path of the air circulated by the air-circulation means.

In yet a further aspect of the invention a plurality of sections are arranged in a standing condition on a base. Mesh sheets are arranged and glued so as to cover both the standing part of the sections and the corresponding parts of the base. A sealant that is applied on the exterior and interior faces of the structure, including the parts covered with a mesh sheet.

In a further aspect of the invention the clayey paint made of natural substances is applied over the sealant that is on the upper part of the body of the structure, and the exterior paint is applied over the sealant that is on the lower part of the body of the structure.

In a further aspect of the invention the knockdown structure has flooring material made of foam polystyrene laid down on the structure's floor.

Advantages of the Invention

The method, according to one embodiment of the present invention provides a method of assembling the knockdown structure that can firmly hold the places where the sections are joined together, by using an adhesive to pasting thereon a woven inorganic-fiber mesh sheet, and then applying thereon a sealant, including mortar, in order to fix the joining. As a result, cracking of the sealant and displacement of the sections can be prevented without fail. Also, to increase the strength of the joining it is not necessary to attach metal reinforcing materials to the places where the sections are joined together, and thus the assembly method can be simplified. Further, because the mesh sheet covers the places where the sections are joined together, it helps to flatten any concave parts that might exist in the junctions. Thus, the mesh sheet has an effect of making it possible to paint the sealant in an even thickness. Therefore, cracks in the sealant, which occur due to uneven thickness, can be prevented. Moreover, because inorganic fiber is mixed into the sealant, the strength of the sealant itself is increased and cracking can be prevented. Degradation of the sections by water and/or ultraviolet light can be prevented because modified silicone paint, which is an exterior paint that is water repellent and can screen out ultraviolet light rays, is applied over the sealant on the exterior face of the structure. Thanks to this water repellency, the paint repels rain and snow, and it seldom comes off, which makes the structure's exterior maintenance-free. A clayey paint made from diatomite or a whitewash is applied over the sealant of the interior face of the structure. And because diatomite or a whitewash can adsorb or decompose poisonous gas emitted from plywood and the like, the livability of the knockdown structure is improved.

In the assembly method, the mesh sheet is pasted so as to cover the whole of the exterior face of the assembled body of the structure, making it possible to fix all of the sections even more strongly.

In the assembly method, the mesh sheet is pasted so as to cover the base and the portions of the sections that are connected to the base, and then the sealant is applied thereon so as to fix the connections, whereby the fixing is done even more firmly.

In the assembly method, the clayey paint made of natural substances is applied over the sealant on the upper part of the interior faces of the structure, and an exterior paint is applied over the sealant on the lower part the interior faces of the structure, resulting in graffiti-proof interior faces, especially the lower part of the interior faces.

The assembly method uses, as the exterior paint, a modified silicone-plastic paint, which has the advantages of being water repellent and able to screen out ultraviolet light, at low cost. Because this paint is water-repellant, the exterior of the structure rarely cracks due to rain or snow.

The assembly method uses diatomite or a whitewash as the clayey paint. Diatomite removes moisture (because of which condensation is prevented), and adsorbs volatile formaldehyde, and it has excellent sound-insulation and deodorization capabilities. Using a whitewash as the clayey paint suppresses the growth of mold because of whitewash's strong alkalinity, and the whitewash also absorbs and decomposes formaldehyde, which is an acidic gas.

The knockdown structure incorporates an air-circulation means and an air-cleaning means inside the knockdown structure, making the structure more comfortable for human living.

The knockdown structure includes an air-circulation means and an air-heating means, which make the structure more comfortable for human living.

The knockdown structure uses, as its flooring material, foam polystyrene, which provides under-floor adiathermancy because foam polystyrene is 98% air.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTIONS OF THE DRAWINGS

Other characteristics and advantages of the invention will become apparent with the aid of the description which follows in conjunction with the appended drawings which represent:

Figure 9:
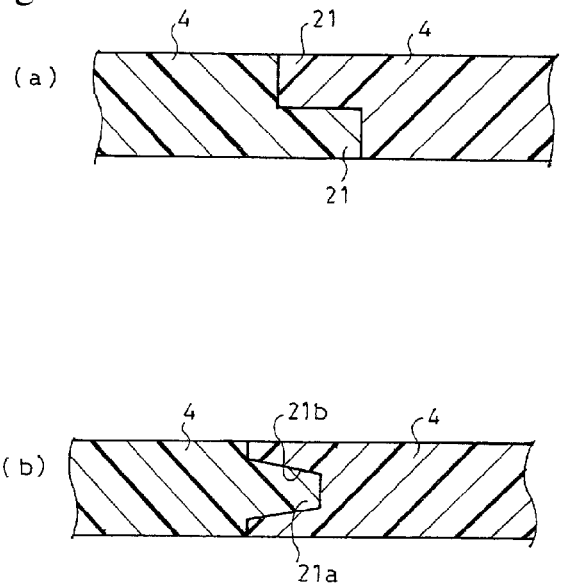

FIG. 9 consists of partial cross-section views of two different types of junction structures of the sections in another embodiment.

Figure 10:
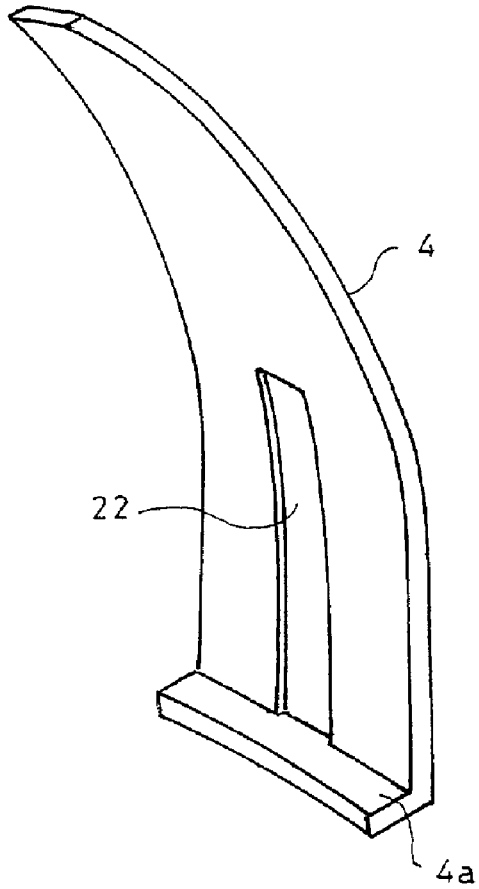

FIG. 10 is a perspective view of a section in another embodiment.

Figure 11:
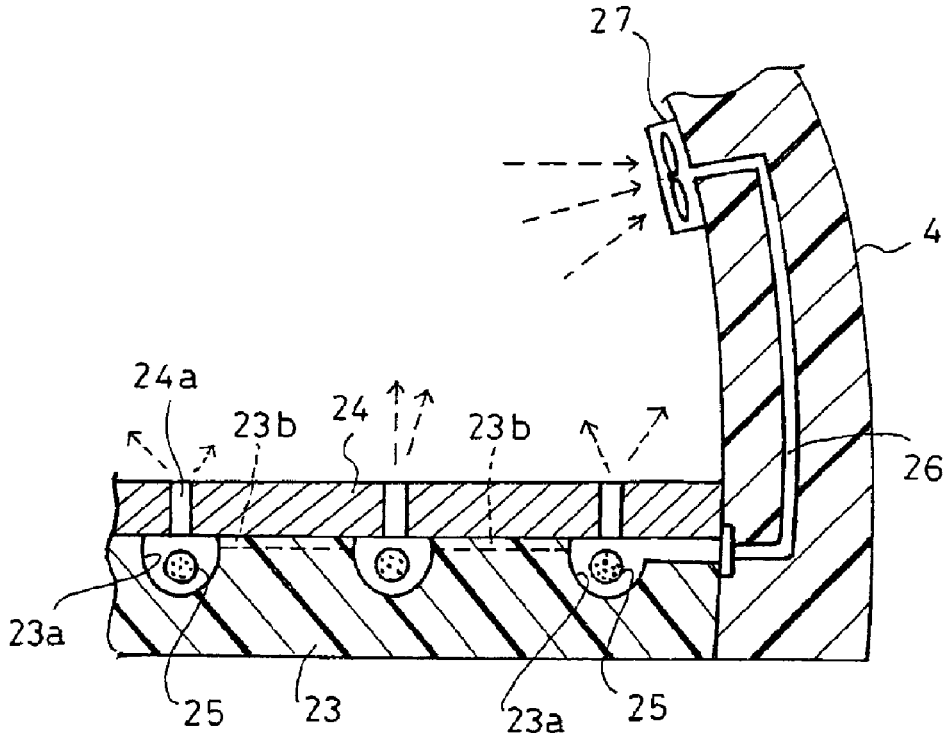

FIG. 11 is a cross-section view of a first example of an embodiment in which a flooring material 23, an air-circulation means, and multiple air-cleaning means are incorporated on the floor.

Figure 12:
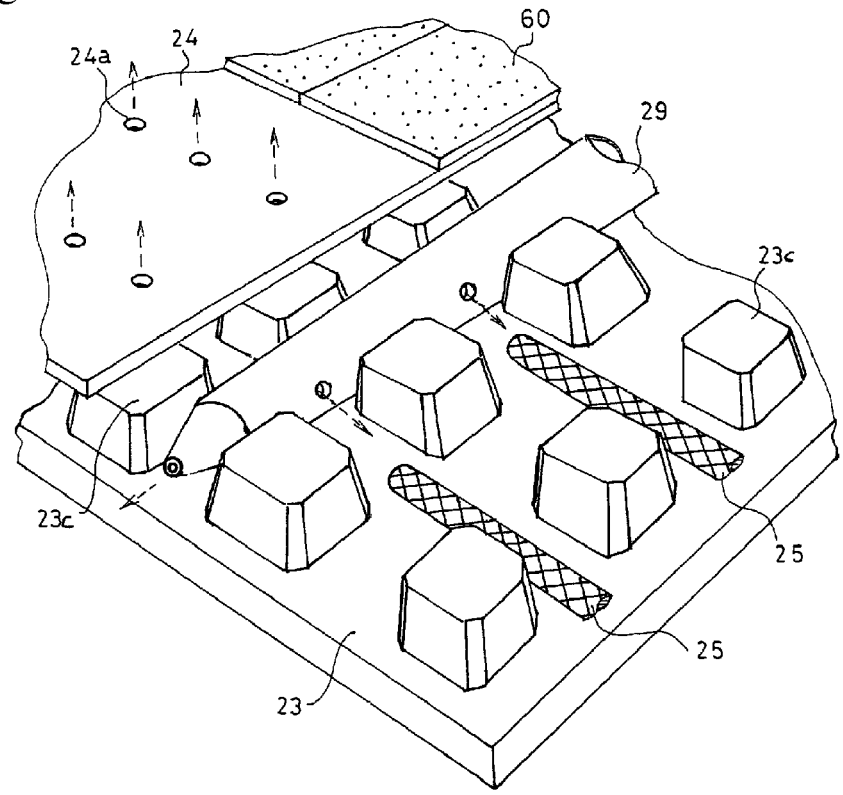

FIG. 12 is an exploded perspective view of a second example of the embodiment, in which a flooring material 23, air-circulation means, and two air-cleaning means are incorporated on the floor.

Figure 13:
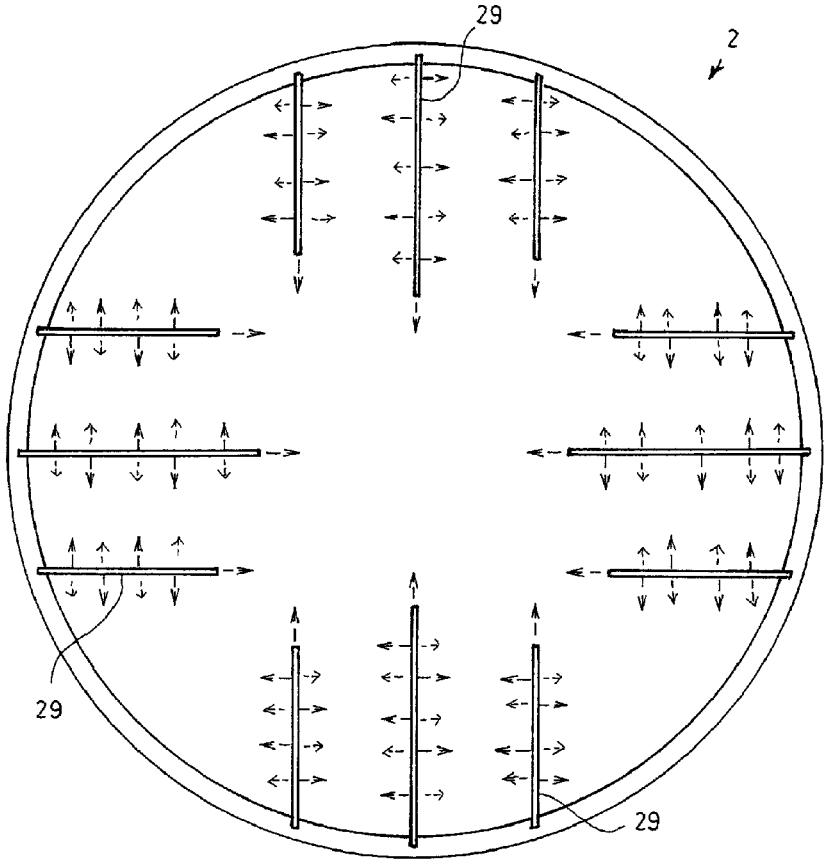

FIG. 13 is a plan view showing the arrangement of under-floor pipes in the embodiment shown in FIG. 12.

Figure 14:
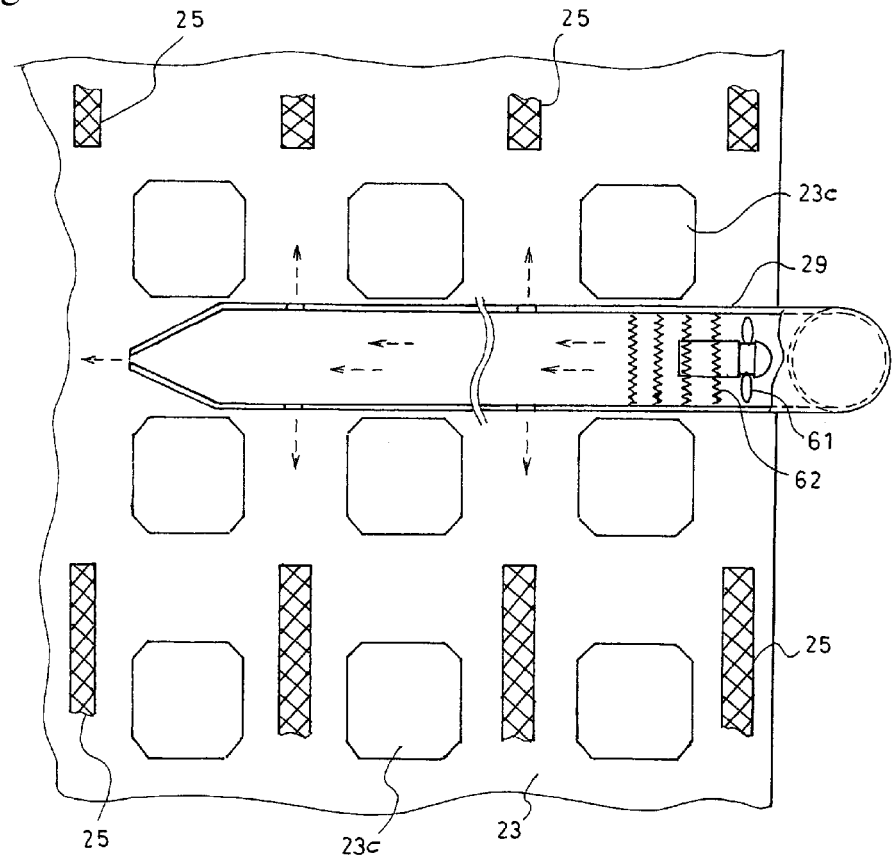

FIG. 14 is a horizontal cross-section view that shows, among other parts, an under-floor pipe in the embodiment shown in FIG. 12.

Figure 15:
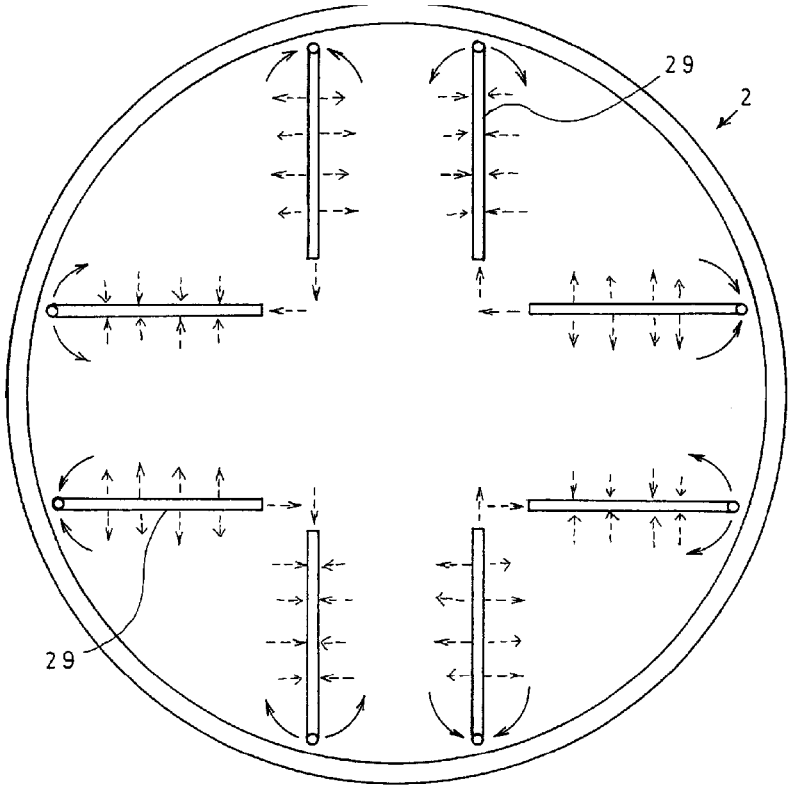

FIG. 15 shows the arrangement of the under-floor pipes in a third example of the embodiment, in which a flooring material 23, air-circulation means, and air-cleaning means are incorporated on the floor.

Figure 16:
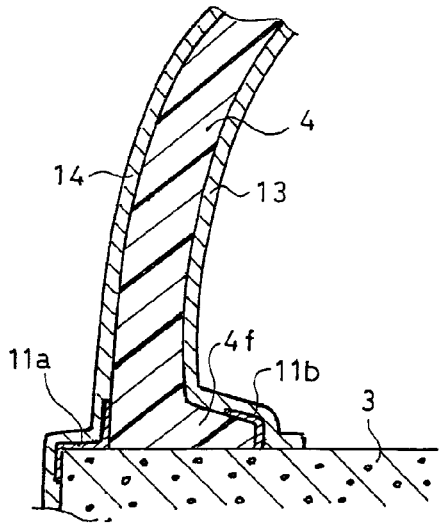

FIG. 16 is a cross-section view of a part of the structure's body, including the mesh sheet used at the junction between the base and a section.

Figure 17:
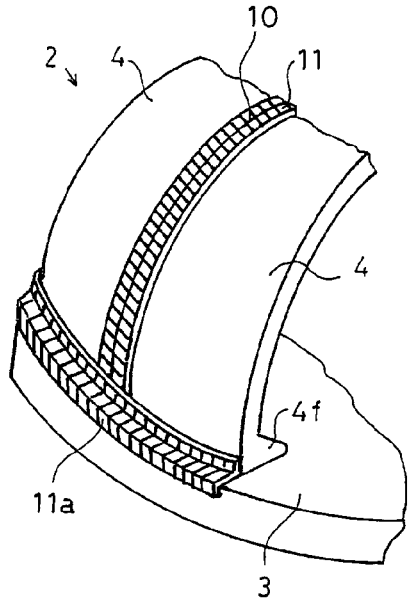

FIG. 17 is a perspective view—from the exterior side of the structure—that shows a mesh sheet at the junction between the base and a section.

Figure 18:
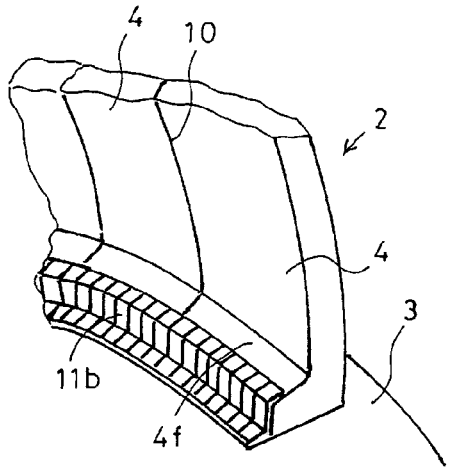

FIG. 18 is a cross-section view—from the interior side of the structure—that shows a mesh sheet at the junction between the base and a section.

Figure 19:
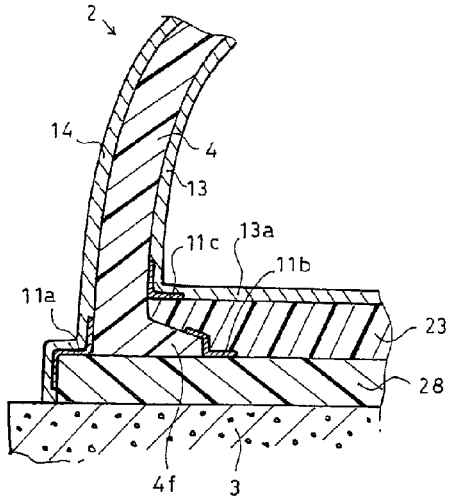

FIG. 19 is a cross-section view that shows a mesh sheet at the junction between the support material, which is disposed on the base, and a section.

Figure 20:
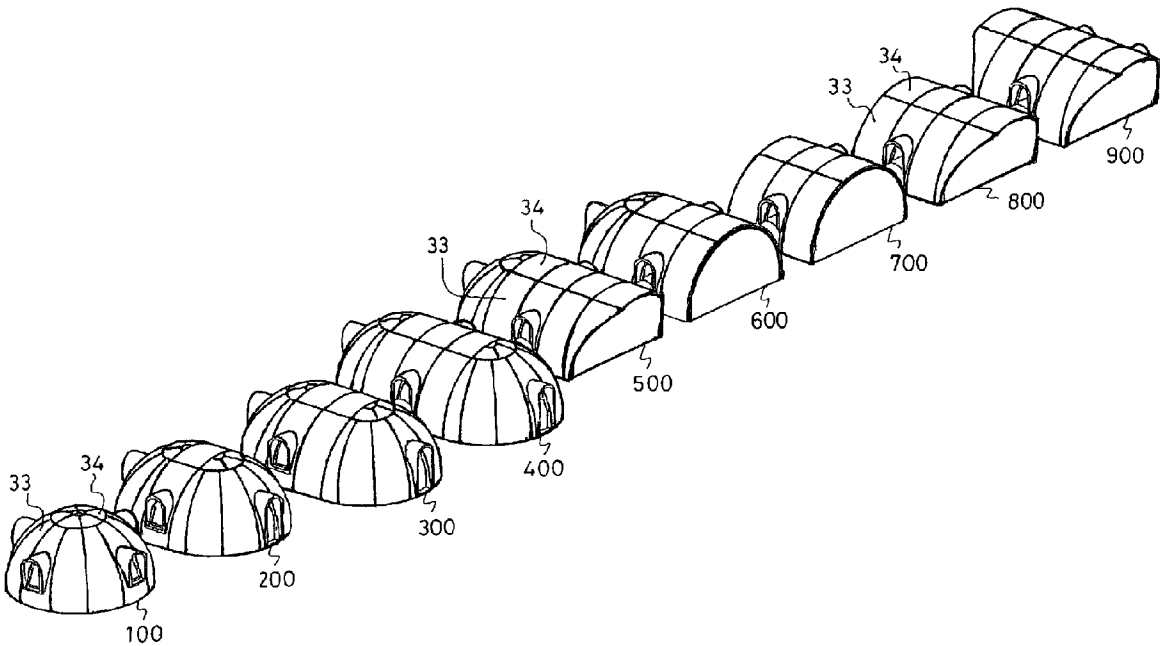

FIG. 20 is a perspective view of a variety of embodiments of the knockdown structure.

EXPLANATION OF THE NUMBERS USED IN THE DRAWINGS

1 knockdown structure
2 structure's body
3 base
3*a* supporting face
3*b* engagement shoulder
4 section
4*a* engagement piece
4*b* notched portion
4*c* end face of section
4*f* foot of section
5 block
6 coupler plate
7 bolt
8 coupling part
10 junction (between sections)
11, 11*a*, 11*b*, 11*c* mesh sheet
13 sealant (interior of structure)
14 sealant (exterior of structure)
15 modified silicone-plastic paint (exterior of structure)
17 modified silicone-plastic paint (interior of structure)
18 diatomite
21 concave-convex portion
21*a* convex portion
21*b* concave portion
22 wiring groove
23 flooring material
23*a* concave portion
23*b* connecting groove
23*c* convex portion
24 floor panel
24*a* ventilation hole
25 air-cleaning device
26 pipe
27 ventilation fan
28 support material
29 pipe
33 side-wall section
34 roof section
60 carpet
61 fan
62 heater
100-900 examples of assembled knockdown structures

PREFERABLE EMBODIMENT OF THE INVENTION

The preferred embodiment of the present invention will now be described.

Figure 1:
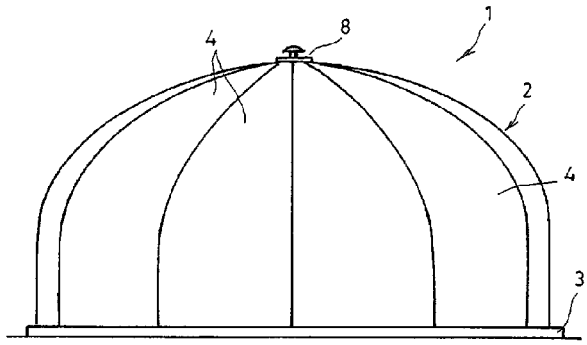
FIG. 1 is a front view of the dome-shaped knockdown structure in one embodiment of the present invention.
Figure 2:
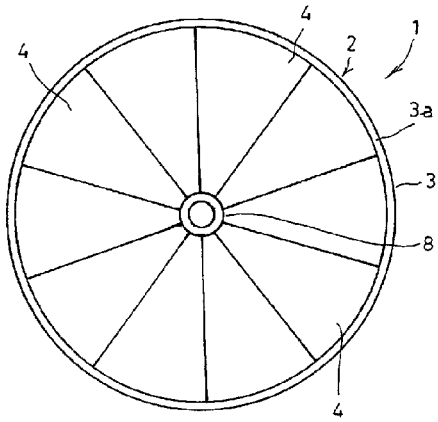
FIG. 2 is a plan view of the knockdown structure.
Figure 3:
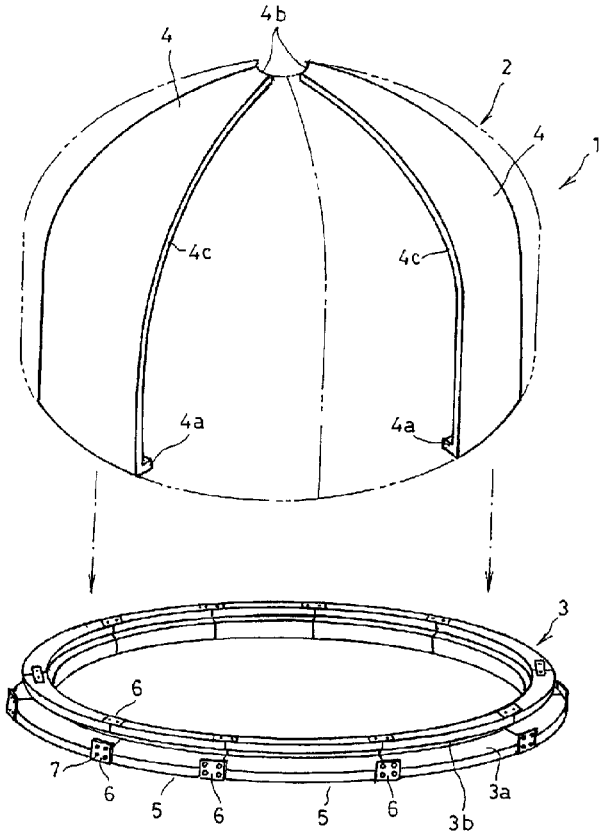
FIG. 3 is an exploded perspective view showing how the knockdown structure is assembled.

FIGS. 1 to 6 show a dome-shaped knockdown structure in one embodiment of the present invention. In this embodiment the knockdown structure 1 has a domed-shaped body 2 as shown in FIGS. 1 to 3, and is assembled by standing the structure's body 2 on a base 3.

The structure's body 2 is assembled by joining a plurality of sections 4 so as to form a circle. More specifically, the sections 4 form the structure's body 2 by joining the end faces of right and left sides of a section with those of neighboring sections. The sections 4 have the shape that results by dividing a dome shape into a plurality of parts forming a radial pattern around the central axis of the dome-shaped structure's body 2. In this case, it is preferable to divide the dome shape into sections 4 of equal size around the central axis. In this embodiment, all of the sections 4 are the same size, resulting in advantages of easy assembly and the capability of using one metal mold for foam-molding all the sections.

Each section 4 is made of foam polystyrene and therefore is lightweight and easy to handle, resulting in easy assembly of the structure's body 2. In this case, the thickness of the section 4 and the foaming scale factor of foam polystyrene are properly chosen according to the environment in which the knockdown structure is used. For instance, in an environment requiring adiathermancy and strength, the foaming scale factor should be small and the sections 4 should be thick, while in a different environment the foaming scale factor could be larger and the thickness of the sections 4 could be less.

Each section 4 stands on the base 3 by engaging the lower end of the section 4 with the base 3. The base 3 is formed of a plurality of blocks 5 that are arranged in an arc made by equally dividing a circle. From a top viewpoint, the base 3 has the shape of a ring due to the plurality of blocks 5 that are joined together so as to form a circle. The blocks 5 are made of concrete or of stainless steel, and are joined together by coupling plates 6 that are made of a corrosion-resistant metal, such as stainless steel, and bolts 7.

A ring shaped supporting face 3*a*, which is to support the lower end face of the section 4, is formed on the base 3. An engagement shoulder 3*b*, which extends upward and bends outward into an L shape, is formed on the supporting face 3*a*. The lower end of the section 4 is inserted between the engaging shoulder 3*b* and the supporting face 3*a*, by which the section 4 is engaged with the base 3. In addition, an engagement piece 4*a* is formed integrally at the lower end of the section 4 by bending the lower end of the section 4 inward.

The engagement piece 4*a* is inserted between the engagement shoulder 3*b* and the supporting face 3*a*.

The upper end of each section 4 has a notched portion 4*b*. The notched portion 4*b* is used in forming a joining hole (not shown) at the top of the structure's body 2 when the sections 4 are joined together to assemble the structure's body 2. A coupling part 8 is installed at the joining hole. The upper ends of the sections 4 are inserted into the coupling part 8 so that the sections 4 are engaged with the coupling part 8 in the same manner whereby the lower end of the section 4 engages with the base 3 (by inserting the lower end of the section 4 between the engagement shoulder 3*b* and the supporting face 3*a*). In this way, the coupling part 8 has an effect of bundling together the upper ends of the sections 4. It is preferable that the coupling part 8 be a top-side ventilator having a ventilation hole and operating gear (not shown) that makes it possible to open and close the ventilation hole.

The procedure for assembling this embodiment of the dome-shaped knockdown structure will now be described, referring to FIGS. 4 to 6.

Figure 4:
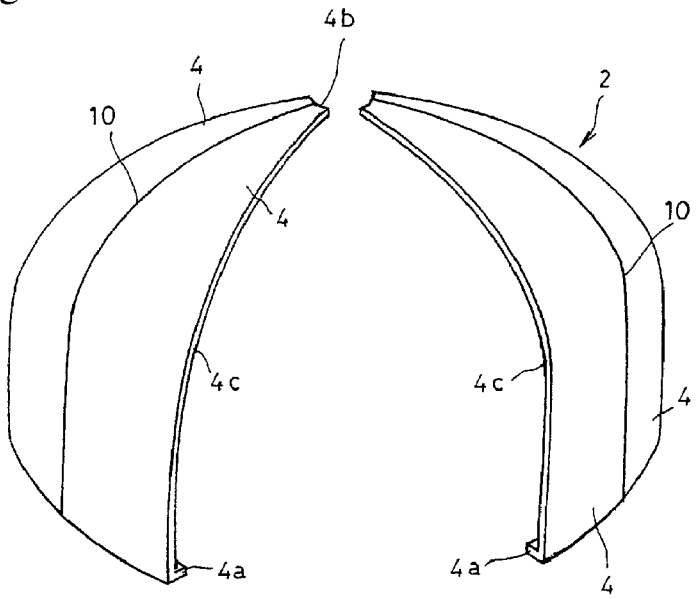
FIG. 4 is a perspective view showing how the sections are joined together.

When joining the sections 4, which are made of foam polystyrene, the end faces 4*c* of neighboring sections are opposite each other (see FIG. 4). In this arrangement, the aforementioned mortar-powder mixed adhesive (not shown) is applied on the end faces 4*c* of the sections 4, and neighboring sections 4 are bonded together by this adhesive. In other words, joints of the structure's body 2 are fixed by the adhesive. In FIG. 4, the number 10 designates a junction (a junction line in this embodiment) between two sections 4 as one of the joints of the structure's body 2. An acrylic resin such as polyacrylic ester or polymethacrylate ester is used as the adhesive. Mortar powder is mixed and dispersed in this acrylic resin, which has a strong ability to bond foam polystyrene with other items, and therefore the mortar powder firmly joins together the sections 4, which are made of foam polystyrene.

The mortar-powder mixed acrylic resin used as the adhesive for the sections 4 is strong and has elasticity, and it also excels in earthquake-resistance and crash-resistance properties. Therefore, the joints of the structure's body 2 will not be cracked even by an earthquake, vibrations, or shock. Moreover, this adhesive is water-resistant, and is able for a long period of time to prevent rain from penetrating the joints. Neighboring sections 4 are joined together by inserting the engagement piece 4*a* that is at the lower end of each section 4, in between the supporting face 3*a* and the engagement shoulder 3*b* of the base 3.

Figure 5:
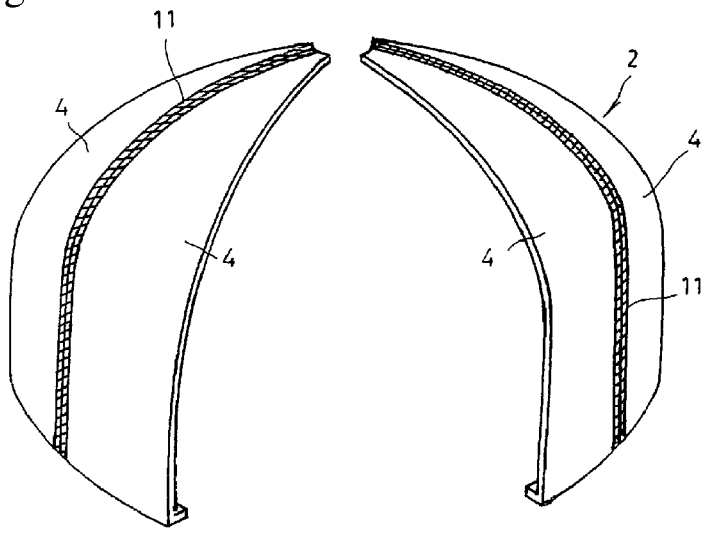
FIG. 5 is a perspective view showing the junctions on which the mesh sheets are pasted.

FIG. 5 shows the dome-shaped structure's body 2 in the process of being assembled by joining together sections 4, with the mesh sheet 11 being pasted onto the joints of the structure's body 2. The adhesive can be a mortar-powder mixed acrylic resin, which is also used for joining together sections 4, as mentioned above. The adhesive is applied in the shape of the mesh sheet 11 that is to be applied thereon, on the corresponding part of the structure's body 2, including the junction. The mesh sheet 11 is then applied on that part of the structure's body 2, after which the adhesive is again applied thinly on the surface of the mesh sheet 11 that has been applied on the structure's body 2. It takes about 24 hours for the adhesive to dry. The mesh sheet 11 is pasted along the junctions 10—which are the joints of the structure's body 2—of the sections 4, in such a way that the mesh sheet 11 covers the whole lengths of the junctions 10.

It is preferable that the mesh sheet 11 be made of an inorganic fiber, such as a carbon fiber, a glass fiber, or a metal fiber. A sheet made of tensional plastic fiber can also be used. It is preferable that the sheet be woven in a mesh. This embodiment of the present invention uses a mesh sheet that is from 0.3-mm to 1-mm thick and whose mesh count is 6 (i.e., six meshes per inch). A mesh sheet whose mesh count is 12 or more is too fine to work with, and a mesh sheet whose mesh count is less than 6 is too coarse. Thus, the joints of the structure's body 2 (the junctions 10 between sections 4; see FIG. 4) have not only the bonding power of the mortar-powder mixed acrylic resin, but also the strength and toughness of the mesh sheet 11. Both the bonding power of the mortar-powder mixed acrylic resin and the strength and toughness of the mesh sheet 11 serve to firmly join the sections 4 together.

In this embodiment, the joining power of the joint 10 is reinforced by pasting the mesh sheet 11 onto the junctions 10 of the sections 4. Because the mesh sheet 11 covers, from above, the concave portions—where the adhesive is not applied sufficiently—of the junctions 10 between the sections 4, unevenness of the appearance is eliminated. Because the outer surface is flattened this way, the sealant, the exterior paint, and the interior a clayey paint, which are to be applied onto the structure's body 2, can each be applied with an even thickness. Therefore, the sealant can be solidified uniformly, resulting in no cracks.

Figure 6:
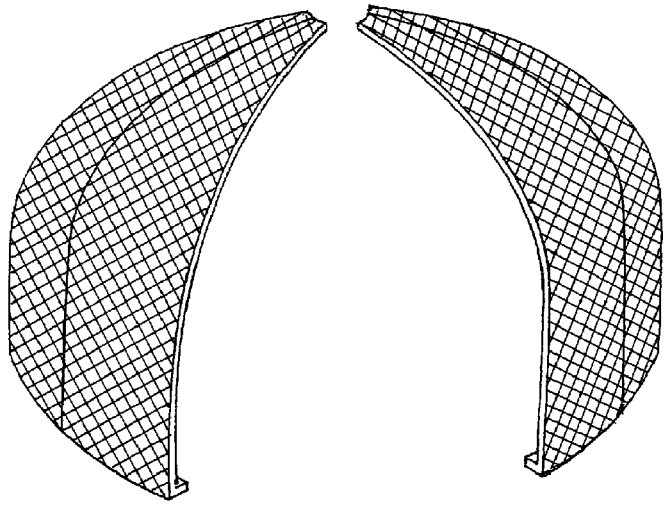
FIG. 6 is a perspective view of the whole structure on which mesh sheets are pasted.

In addition, as shown in FIG. 6, the mesh sheet 11 can be applied so as to cover the structure's body 2 in its entirety, including the junctions 10 of the sections 4.

After the mesh sheet 11 is applied, the sealant is applied in a predetermined thickness on the exterior and interior faces of the knockdown structure's body 2. Plastic paint into which a dispersing fiber (such as a glass fiber or a carbon fiber) and mortar powder are dispersed, is used as the sealant. The plastic paint can be an acrylic resin (such as polymethacrylate ester or polyacrylic ester) or another resin. The sealant should be from 1-cm to 3-cm thick. A sealant like this is thinner than a conventional one.

Figure 7:
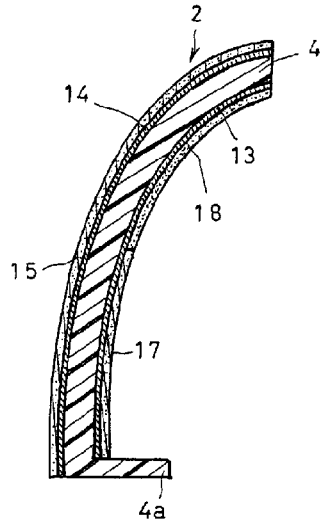
FIG. 7 is a partial cross-section view of a section of the structure's body.

In FIG. 7, the number 13 refers to the sealant that is applied on the interior of the structure's body 2 (section 4), and the number 14 refers to the sealant that is applied on the exterior of the structure's body 2. By using the above-mentioned composition as the sealants 13 and 14, the joints of the sections 4 are maintained firmly. Moreover, because the sealants contain fiber, cracking rarely occurs after the sealants are applied on the structure's body 2. Further, the sealants contain mortar powder, and thus a hard and tough film results. Therefore, even if the inner sections 4 (made of foam polystyrene) vibrate, the vibration is not transmitted outward.

After the sealants 13 and 14 are applied, an exterior paint is applied on the surface of the sealant 14 of the exterior faces of the structure's body 2, and the paint for the interior is applied on the surface of the sealant 13 of the interior faces of the structure's body 2.

Paint that is water-repellent and that can screen out ultraviolet light is used as the exterior paint. For a paint having such properties, a modified silicon-plastic paint or another plastic paint can be used. In FIG. 7, the number 15 refers to a modified silicon-plastic paint that is applied over the sealant 14 on the exterior face of the structure's body 2.

The modified silicon-plastic paint 15 contains silicon particles, and therefore it is highly water-repellant and can repel rain and snow. In addition, the modified silicon-plastic paint 15 has a strong ability to bond with the sealant 14, and so the paint never comes off. Therefore, even if the dome-shaped structure 1 is assembled outdoors, it has high durability and therefore can be used for a long period of time.

In addition, because the modified silicon-plastic paint 15 can screen out ultraviolet light, its application on the exterior face of the structure's body 2 prevents ultraviolet light from penetrating through the modified silicon-plastic paint 15 to the sections 4, which helps to prevent the sections 4 from degrading. Further, because the modified silicon-plastic paint 15 has low surface tension, it rarely gets smudged. Therefore, cleaning the exterior face of the structure's body 2 is easy, so that maintenance is easy. For the modified silicon-plastic paint having the abovementioned properties, an alkyd modified-silicon paint or the like is used. For the modified silicon-plastic paint that is used to paint the exterior of the structure's body 2, a paint made from a pigment such as white titanium pigment or mica can be mixed, so that coloring the exterior face of the structure's body 2 is easy.

For the paint that is applied over the sealant 13 of the interior faces of the structure's body 2, a clayey paint made of natural substances is used. Diatomite or a whitewash can be used for the clayey paint made of natural substances. In FIG. 7, the number 18 refers to diatomite as the clayey paint made of natural substances. This diatomite 18 is used for the upper part of the interior faces of the structure's body 2.

In this case, the lower part of the interior faces of the structure's body 2 is covered with the same exterior paint as that used for the exterior faces of the structure's body 2, as described above. The number 17 refers to the modified silicon-plastic paint as the exterior paint that is applied on the lower part of the interior faces of the structure's body. Applying the modified silicon-plastic paint 17 on the lower part of the structure's body 2 can give the abovementioned properties to the lower part of the structure's body 2. Because the modified silicon-plastic paint 17 is applied on the lower part of the interior faces of the structure, the surface tension of the lower part is low, and so graffiti is difficult to attach on the lower part. And when that occurs, it is easy to wipe off the graffiti. Therefore, cleaning the knockdown structure 1, when used as a leisure facility, is easy.

The main ingredient of the diatomite 18 that is applied on the upper part of the interior faces of the structure's body 2 is phytoplanktons, which are algae. The primary ingredient of diatomite 18 is silicon dioxide, and the diatomite 18 is clayey. Diatomite 18, which mainly consists of silicon dioxide, is heat-resistant, and so even if a lit cigarette or other object that is on fire touches it, it does not easily burn and is safe from fire.

Moreover, the diatomite 18 adsorbs and removes formaldehyde, and so it prevents formaldehyde—which can be emitted by the sealant 13 and the modified silicon-plastic paint 17—from remaining inside the structure. Further, diatomite 18 adsorbs and removes poisonous materials, thereby contributing to safety, and it has deodorizing capability and the ability to prevent ticks and mold from growing. Therefore, the dome-shaped structure does not adverse affect the health of a user or the structure's suitability for human living.

In this embodiment, a whitewash can be used instead of diatomite 18 as the clayey paint made of natural substances to be applied on the upper part of the interior faces of the structure's body 2. The primary ingredient of whitewash is calcium hydroxide from soil. Mixing the whitewash with hemp, marine algae and the like causes it to becomes clayey. Whitewash has the same effect of adsorbing and removing formaldehyde as diatomite 18 does, thereby preventing the adverse health effects that can result from formaldehyde. In addition, the whitewash can be applied again, and therefore if smudge that is hard to remove sticks to the surface, the condition can easily be remedied by simply applying a new coat of whitewash. Whitewash is also fire-resistant and does not combust easily.

In this embodiment of the dome-shaped knockdown structure 1, the sections 4 can be joined together firmly, surely preventing unintentional disassembly after assembly. Further, metal reinforcing members are not needed to increase the strength of the knockdown structure 1. This makes it easy to assemble the knockdown structure 1 and to simplify the structure of the knockdown structure 1, i.e., the structure's body 2.

Figure 8:
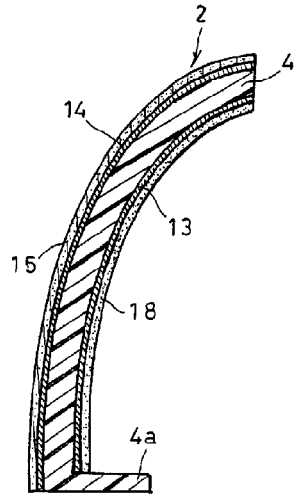
FIG. 8 is a partial cross-section view of a section of the structure's body in another embodiment.

FIG. 8 shows a cross-section of a section 4 of another embodiment of the present invention. In this embodiment, as in the first embodiment, a mesh sheet mixed with inorganic fiber is glued along the junction lines between the sections 4, which are made of foam polystyrene and that compose the structure's body 2. On the exterior and interior faces of the structure's body 2, sealants 13 and 14—which are made by dispersing resin and mortar powder in a plastic paint such as acrylic resin and the like—are applied. Further, the modified silicon-plastic paint 15 is applied over the sealant 14 of the exterior faces of the structure's body 2 as an exterior paint that has the ability to repel water and to screen out ultraviolet light.

In the embodiment shown in FIG. 8, diatomite 18—as the clayey paint made of natural substances—is applied on the interior faces of the structure's body 2. The diatomite 18 is applied on the entirety of all of the interior faces of the structure's body 2 so that it is not necessary to paint the upper and lower parts of the interior faces differently, as is done in the embodiment shown in FIG. 7. Moreover, because the diatomite 18 is applied on the entirety of all of the interior faces of the structure's body 2, it adsorbs and removes formaldehyde and poisonous materials, and prevents ticks and mold from growing on the interior faces. Also, in this embodiment a whitewash, instead of diatomite 18, can be applied on the entirety of all the interior faces of the structure's body 2.

FIG. 9 shows two forms of the junctions between sections 4. In FIG. 9*a*, stepwise concave-convex portions 21 are formed at opposite side-faces of the sections 4 so as to engage with each other. In FIG. 9*b*, convex and concave portions 21*a*, 21*b* are formed at opposite side-faces of sections 4 so as to engage with each other. Plastic paint mixed with inorganic fiber and mortar powder is applied between the opposite side-faces so as to join the sections 4 together. With this structure of mutual engagement, the sections 4 can be bound together very firmly. Therefore, the sections 4 can be joined strongly. The shape of the side-faces of a section 4 is not limited to the forms shown in the figures, and the shape can be modified in various ways. In the arrangement shown in FIG. 9, the mesh sheet 11 described earlier (not shown) can be applied so as to cover the junctions between sections 4, enabling the sections 4 to be very firmly joined together.

FIG. 10 shows another form of the section 4. In this form, a wiring groove 22 for electric cords and the like is formed on the interior face of the section. The wiring groove 22 is made by moving an electric iron or the like on the interior face of the section 4. The wiring groove 22 can be formed easily because the section 4 is made of foam polystyrene. Electric cords, LAN cables for a personal computer, and other wires or cables can be put in the wiring groove 22, and the wiring groove 22 is sealed by the exterior paint described above, by a clayey paint, or by a dedicated mounting material. With this wiring groove 22, a power supply and signal-transmission capability can be provided for electric lights, a refrigerator, a television, a personal computer, and/or other electric equipment, thereby improving the usefulness of the knockdown structure 1. Grooves 22 can also be formed on the exterior face of a section 4.

In the present invention, a flooring material made of foam polystyrene can be provided for the floor of the structure's body 2. Using foam polystyrene as the flooring material makes the floor adiathermic—as with the walls, which are formed of sections 4 and are adiathermic—and therefore livability is improved.

FIG. 11 is a cross-section view of a first example of an embodiment in which a flooring material 23, an air-circulation means, and an air-cleaning means are incorporated on or in the floor."> The flooring material 23 is allocated on the floor of the structure's body 2, which is comprised of sections 4. This flooring material 23 can be formed by joining together sections made of foam polystyrene, using an adhesive. A flooring panel 24, which is made of resin, is laid on the flooring material 23.

Next, as shown in FIG. 11, the air-circulation means comprises concave portions 23*a* that are arranged at proper intervals on the upper surface of the flooring material 23; connecting grooves 23*b* that link neighboring concave portions 23*a*; ventilation holes 24 in the flooring panel 24; pipes 26 that are installed in the side walls; and a ventilation fan 27. In each concave portion 23*a*, an air-cleaning device 25, which is made of bamboo carbon, activated carbon, or the like. Accordingly, air inside the structure's body 2 is moved into and through the section 4 via the fan 27, returning to the inside of the structure per se through ventilation holes 24*a* after dust and odor have been removed by the air-cleaning device 25. Thereby the air inside the structure's body 2 can be cleaned, further improving the livability of the knockdown structure.

FIG. 12 is an exploded perspective view of a second example of the embodiment, in which a flooring material, an air-circulation means, and an air-cleaning means are incorporated in the floor. In the example shown in FIG. 12, the under-floor pipe 29 is used for the under-floor portion of the airflow path. The configuration of the remaining parts—the flooring panel 24, ventilation holes 24*a*, a flooring material 23 made of foam polystyrene, convex portions 23*c*, an air-cleaning device 25—is the same as that shown in FIG. 11. Also, the carpet 60 is made of an air-permeable material.

FIG. 13 is a plan view showing the layout of the under-floor pipe 29 in the embodiment shown in FIG. 12. The under-floor pipes 29 are arranged in such a way that one end of each pipe is connected with the side wall of the structure's body 2 and the other end of the pipe faces the central part of the structure. The under-floor pipes 29 could instead be arranged radially. For this example, a total of 12 under-floor pipes are used. Thus, cleaned air rises upwards in the structure through the ventilation holes 24*a* that are located throughout the flooring panel 24. The steams of upward-rising air from all portions of the structure's body 2 meet together in the upper part of the structure 1 and then circulate within the structure 1.

FIG. 14 is a horizontal cross-section of the under-floor pipe 29. As shown in FIG. 14, a fan 61 and a heater 62 are provided inside the under-floor pipe 29 so as to heat and circulate air.

FIG. 15 is a layout drawing showing the arrangement of the under-floor pipes of a third example of the embodiment, in which a flooring material is provided on the floor, and an air-circulation means and an air-cleaning means are incorporated in the floor. This third example, unlike the embodiment depicted in FIG. 11, does not include pipes 26 in the side wall of the section 4, or a ventilation fan 27. The openings at the two ends of the under-floor pipe 29 (indicated by arrows in solid lines) becomes either an exhaust or an inhale nozzle, depending on the rotational direction of the fan in the under-floor pipe 29.

FIGS. 16 to 18 shows another embodiment for using the mesh sheet. The mesh sheet 11 is applied on the junctions 10 between adjacent sections 4. The mesh sheet 11 is also applied along the junction between each section 4 and the base 3, as shown in FIG. 16, in which the numbers 11*a* and 11*b* refer to the mesh sheet. The mesh sheets 11*a* and 11*b* are applied on the outer and inner peripheries, respectively, of the structure's body 2, as shown in FIGS. 16 to 18.

The mesh sheet 11*a* is applied on the lower end of the exterior face of the sections 4 of the structure's body 2 and the corresponding part of the base 3, as shown in FIG. 17. The mesh sheet 11*a* covers the outer periphery of the lower end of the structure's body 2, and is applied seamlessly over the lower end of the sections 4 and over the base 3. Likewise for the interior faces of the structure's body 2, the mesh sheet 11*b* is applied seamlessly over the lower end of the section 4 and the base 3, as shown in FIG. 18. At the lower end of the inner face of the sections 4, a foot 4*f* that extends towards the interior of the structure is formed, and the mesh sheet 11*b* is applied over the foot 4*f* and the corresponding part of the base 3. For the interior and exterior faces of the structure's body 2, sealants 13 and 14 are applied so as to cover the mesh sheets 11, 11*a*, and 11*b*, so as to prevent the appearance from deteriorating.

The mesh sheets 11*a* and 11*b*, in addition to being applied on the junctions 10 between sections 4, are applied on the portion of each section 4 that connects with the base 3, as well as with the corresponding part of the base 3. Thus, the strength of the bonding of the sections 4 to the base 3 is increased, which enables the structure's body 2 to stand steadily on the base 3.

FIG. 19 is a cross-section view showing that mesh sheets are pasted on the junction of the support material and the section 4, both of which are arranged on the base 3. In this embodiment, the support material 28, made of foam polystyrene, is fixed onto the base 3, which is made of concrete. The support material 28 constitutes a part of the base 3. A plurality of sections 4 are arranged in a standing condition on the support material 28. The mesh sheets 11*a* and 11*b* are applied on the part of each section 4 that rises from the support material 28, and on the corresponding part of the support material 28. The mesh sheet 11*a* is applied on the lower part of the exterior faces of the sections 4 of the structure's body 2, and the mesh sheet 11*b* is applied on the lower part of the interior face of the sections 4.

In the embodiment shown in FIG. 19, the flooring material 23 is laid on the support material 28, which is on the base 3, and the mesh sheet 11*c* is applied over a boundary part between this flooring material 23 and each of the sections 4 The mesh sheet 11*c* is applied so as to cover the corner part of the structure's body 2, which is the boundary part between the section 4 and the flooring material 23. More specifically, the mesh sheet 11*c* is seamlessly applied on the corners of the interior faces of the section 4 of the structure's body 2. Thus, the strength of the bonding between each of the sections 4 and the flooring material 23 is increased, enabling the structure's body 2 and the flooring material 23 to be joined together under a very stable condition.

FIG. 20 is a perspective view of a variety of shapes of knockdown structures. They are: 100, a domed-type; 200 to 400, long domed-types; 500, a domed-type that has one 90-degree-vertical side and one inward-slanting vertical end; 600, a domed-type that has one 90-degree vertical end; 700, a domed-type that has two 90-degree-vertical ends; 800, a domed-type that has one 90-degree-vertical end and one inward-slanting vertical end; and 900, a domed-type that has two inward-slanting vertical ends.

These models have side walls and roofs. The side walls are assembled by joining side-walls of neighboring sections 33, and the roofs are formed by joining roofs of neighboring sections 34. The side-wall sections 33 and 34 are made of foam polystyrene, and the mesh sheet 11 described above is used to join the sections together. Thus, the bonding strength between the sections is improved, enabling the knockdown structure to have a stable structure.

INDUSTRIAL APPLICABILITY

The knockdown structures and the assembly methods thereof described in the present invention are suitable for outdoor facilities used as accommodation facilities, leisure facilities, and facilities used for other purposes.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A method of assembling a knockdown structure, said method comprising the following steps:

assembling a body of the structure, which has a predetermined shape, by using a mortar-powder mixed adhesive to join together a plurality of sections that are made of foam polystyrene and that constitute parts of the structure;

applying an adhesive on a mesh sheet, which includes a woven inorganic fiber, in such a way that the mesh sheet is glued to (i) the places where the sections are joined together, with the adhesive bonding the sections together, (ii) both the standing part of the sections and the corresponding parts of the base of both the exterior and interior faces of the body of the structure, and (iii) the whole circumference of the outer upper surface of the base excluding the parts of the base that contact the standing part of the sections;

applying, in a predetermined thickness, a sealant, which is made by dispersing inorganic fiber and mortar powder in a plastic-type paint, on the exterior and interior faces of the body of the structure;

applying, over the sealant that is on the exterior faces of the body of the structure, an exterior paint that is water repellent and that adapted to screen out ultraviolet light; and applying, over the sealant that is on the interior faces of the body of the structure, a clayey paint, including diatomite or a whitewash, that is made of natural substances.

2. The method according to claim 1, of assembling the knockdown structure, wherein the mesh sheet is placed and glued in such a way that it covers almost all of the exterior of the assembled body of the structure.

3. The method according to claim 1, of assembling the knockdown structure, wherein the sealant that is applied to the upper half of the interior faces of the body of the structure is covered by the clayey paint that is made of natural substances, and the sealant that is applied to the lower half of the interior faces of the body of the structure is covered by the exterior paint.

4. The method of assembling according to claim 1, of assembling the knockdown structure, wherein a modified silicone-plastic paint is used as the exterior paint.

5. A knockdown structure, comprising:

a body including a plurality of sections joined together, said sections made of foam polystyrene and divided into parts of the body of the structure, which has a predetermined shape, using an adhesive mixed with mortar powder;

a mesh sheet having a woven inorganic fiber and arranged in such a way that the mesh sheet covers (i) the places where the sections are joined together, (ii) both the standing part of the sections and the corresponding parts of the base of both the exterior and interior faces of the body of the structure, and (iii) the whole circumference of the outer upper surface of the base excluding the parts of the base that contact the standing part of the sections;

a sealant, which is made by dispersing inorganic fiber and mortar powder in a plastic-type paint, is applied on the exterior and interior faces of the body of the structure in a predetermined thickness;

an exterior paint, which is water-repellent and adapted to screen out ultraviolet light, applied over the sealant that is on the exterior of the structure; and a clayey paint, namely diatomite or a whitewash, that is made of natural substances, applied over the sealant that is on the interior of the structure.

6. The knockdown structure as described in claim 5, wherein the mesh sheet covers almost all of the exterior of the structure.

7. The knockdown structure as described in claim 5, further comprising:

an air-circulation means to circulate, through the sections, the air inside the structure, and an air-cleaning means disposed in a flow path of the air that is circulated by the air-circulation means.

8. The knockdown structure according to claim 5, further comprising:

an air-circulation means to circulate, through the sections, the air inside the structure, and an air-heating means disposed in a flow path of the air circulated by the air-circulation means.

9. The knockdown structure as described in claim 5, wherein the clayey paint made of natural substances is applied over the sealant that is on the upper part of the interior faces of the body of the structure, and the exterior paint is applied over the sealant that is on the lower part of the body of the structure.

10. The knockdown structure according to claim 5, wherein the exterior paint is a modified silicon-plastic paint.

11. The knockdown structure according to claim 5, wherein flooring material made of foam polystyrene is laid on the structure's floor.

* * * * *